US010708687B1

(12) United States Patent
Gedney et al.

(10) Patent No.: US 10,708,687 B1
(45) **Date of Patent: *Jul. 7, 2020**

(54) SYSTEM AND METHOD FOR INCLUDING SOUNDSCAPES IN ONLINE MAPPING UTILITIES

(71) Applicant: Ocean Acoustical Services and Instrumentation Systems, Inc., Lexington, MA (US)

(72) Inventors: Charles Gedney, Sudbury, MA (US); Vincent E. Premus, Pepperell, MA (US); Philip Abbot, Lexington, MA (US)

(73) Assignee: Ocean Acoustical Services and Instrumentation Systems, Inc., Lexington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/926,374

(22) Filed: Mar. 20, 2018

Related U.S. Application Data

(63) Continuation of application No. 15/676,605, filed on Aug. 14, 2017, now Pat. No. 9,949,020.

(Continued)

(51) Int. Cl.

| | |
|---|---|
| ***H04R 29/00*** | (2006.01) |
| ***H04R 1/40*** | (2006.01) |
| ***H04R 3/00*** | (2006.01) |

(52) U.S. Cl.

CPC ..... *H04R 1/406* (2013.01); *H04R 3/005* (2013.01); *H04R 29/005* (2013.01); *H04R 2201/401* (2013.01)

(58) Field of Classification Search

CPC ..... H04R 1/406; H04R 3/005; H04R 29/005; H04R 2201/401

(Continued)

(56) References Cited

U.S. PATENT DOCUMENTS 5,175,710 A * 12/1992 Hutson ..... G01S 3/802 367/135

6,058,075 A 5/2000 Bourdelais (Continued)

FOREIGN PATENT DOCUMENTS

CN 104730528 1/2015

OTHER PUBLICATIONS

Manolakis et al., "Statistical and Adaptive Signal Processing" McGraw-Hill, 2000, 807 pages.

(Continued)

*Primary Examiner* — Katherine A Faley

(74) *Attorney, Agent, or Firm* — Cesari and McKenna, LLP

(57) ABSTRACT

Systems and methods are disclosed, which include or present "soundscapes" in or for online mapping utilities. To obtain the data for such soundscapes, along with cameras for visual images, a microphone array can be mounted on a vehicle to record sounds along the streets travelled for linking to an online map. A speech recognition algorithm is used to identify private conversations and remove them from the recording. The systems and methods for accomplishing this task include use of an array of microphones mounted in a special pattern with special materials on top of the vehicle to record sounds as the vehicle travels through space and time. A set of signal processing algorithms is also used to process the microphone signals autonomously in real-time, allowing the operator to immediately review them for quality assurance.

11 Claims, 5 Drawing Sheets

Related U.S. Application Data

(60) Provisional application No. 62/374,432, filed on Aug. 12, 2016.

(58) Field of Classification Search
USPC ..... 381/56
See application file for complete search history.

(56) References Cited

U.S. PATENT DOCUMENTS

| | | | | |
|---|---|---|---|---|
| 6,501,705 | B1 | 12/2002 | Molini et al. | |
| 6,914,854 | B1 | 7/2005 | Heberley et al. | |
| 6,980,486 | B1 | 12/2005 | Kneipfer et al. | |
| 7,106,656 | B2 | 9/2006 | Lerro et al. | |
| 7,319,640 | B1 | 1/2008 | Donald et al. | |
| 7,760,587 | B2 | 7/2010 | Abbot et al. | |
| 8,068,385 | B2 | 11/2011 | Jiang | |
| 8,107,320 | B2 | 1/2012 | Novick et al. | |
| 8,694,306 | B1 | 4/2014 | Short et al. | |
| 9,869,752 | B1 | 1/2018 | Premus et al. | |
| 2003/0227823 | A1 | 12/2003 | Carter et al. | |
| 2004/0263636 | A1* | 12/2004 | Cutler ..... | H04N 7/15 348/211.12 |
| 2010/0046326 | A1 | 2/2010 | Lovik | |
| 2010/0315904 | A1 | 12/2010 | Brinkmann et al. | |

OTHER PUBLICATIONS

"LMR Program Launches Efforts to Improve Marine Species Monitoring techniques, equipment and analyses," CURRENTS The Navy's Energy & Environmental Magazine, Spring 2015, 17 pages.

Bono, et al., "Subband Energy Detection in Passive Array Processing," Texas University at Austin Applied Research Labs, pp. 25-30, 2000.

Kneipfer, Ronald R., "Sonar Beamforming—An Overview of Its History and Status," Naval Undersea Warfare Center Detachment, Technical Report 10, 003, 27 pages, Apr. 7, 1992.

Wenz, Gordon M., "Acoustic Ambient Noise in the Ocean: Spectra and Sources" The Journal of the Acoustical Society of America, vol. 34, No. 12, pp. 1936-1956, Dec. 1962.

Verfub, U.K., et al., "BIAS Standards for noise measurements. Background information, Guidelines and Quality Assurance" BIAS (Baltic Sea Information of the Acoustic Soundscape,) 71 pages, 2014.

Zarnich, Robert E., "A Fresh Look at Broadband Passive Sonar Processing" in Proceedings of the 1999 Adaptive Sensor Array Processing Workshop (ASAP '99), MIT Lincoln Laboratory, Lexington, MA Mar. 1999.

* cited by examiner

SYSTEM AND METHOD FOR INCLUDING SOUNDSCAPES IN ONLINE MAPPING UTILITIES

RELATED APPLICATION

The present application is a continuation of U.S. patent application Ser. No. 15/676,605, titled "System and Method for Including Soundscapes in Online Mapping Utilities" filed Aug. 14, 2017, which claims the benefit of and priority to U.S. Provisional Patent Application No. 62/374,432, titled "System and Method for Including Soundscapes in Online Mapping Applications," filed Aug. 12, 2016; the entire contents of these prior applications are incorporated herein by reference.

BACKGROUND

Online mapping applications have been developed that allow users the ability to traverse a route on an online map while viewing a representation of the traversed map route on a display screen, typically on a computer or mobile device. The maps that are accessed are often referred to as interactive maps, indicating the ability of a user or viewer to interact with the online map. A notable example of such an online mapping application is Google's Streetview, which is available with Google's Maps and Earth applications. Other mapping applications include but are not limited to: WorldMap a free, Open Source GIS tool that provides the technology to create and customize many-layered maps, collaborate, georeference online and historical maps and link map features to related media content; Open Street Map, a worldwide street map with downloadable data; Portable Atlas, an open-source online atlas.

A notable feature of many online mapping applications is the ability to view actual photographs or videos taken at locations indicated on an inline map route of interest. Some mapping applications further include the capability of viewing such recorded images along various "views" or "poses" of the field of view ("FOV"), which is shown as the current screen view that the user views. Using the mapping application, the user may also have the ability to direct the view in a new direction, or bearing, commonly rotation of the FOV about the vertical axis.

While such online mapping applications have provided a user (viewer) the ability to view locations along a mapped route, and various views (poses of the FOV) at those locations, they have not typically included sound.

SUMMARY

System and methods are disclosed herein, which include or present "soundscapes" in or for online mapping utilities such as Google's "Street View," and the like. The soundscapes are recorded from multi-element arrays that have physically been located at the mapped locations, and present listeners who are viewing an online mapping application with a true 360 degree auditory representation of the sound at that particular location shown via the online mapping application.

To obtain the data for such soundscapes, along with cameras for visual images, a microphone array can be mounted on a Street View Vehicle to record sounds along the streets travelled for linking to an online map. When users engage the street view function, their computer would be able to play the local soundscape along with the visual images. The array is used to separate sounds coming from different directions and filter out unwanted sounds. Only sounds coming from the direction the viewer is facing would be presented, while the noise from the platform (street view vehicle) is filtered out of the recording. Not only is the soundscape dependent on the direction of view but the position in space and time. The user could adjust the time and day to sample the time variable as well as move in space. A speech recognition algorithm can be used to identify private conversations and remove them from the recording. The system and method for accomplishing this task includes an array of microphones mounted on a vehicle to record sounds as the vehicle travels through space and time. A set of signal processing algorithms is also used to process the microphone signals autonomously in real-time as they are recorded.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION

Illustrative embodiments are now discussed and illustrated. Other embodiments may be used in addition or instead. Details which may be apparent or unnecessary may be omitted to save space or for a more effective presentation. Conversely, some embodiments may be practiced without all of the details which are disclosed.

An aspect of the present disclosure is directed to systems and methods that include or present "soundscapes" in or for online mapping utilities such as Google's "Street View," and the like. The soundscapes are recorded from multi-element arrays that have physically been located at the mapped locations, and present listeners who are viewing an online mapping application with a true auditory representation of the sound at that particular location shown via the online mapping application; these true representations can, depending on the configuration of the auditory array that is used, cover up to a full 360 degrees (2π radians) in the horizontal plane or a full 4π steradians of solid angle.

Figure 1:
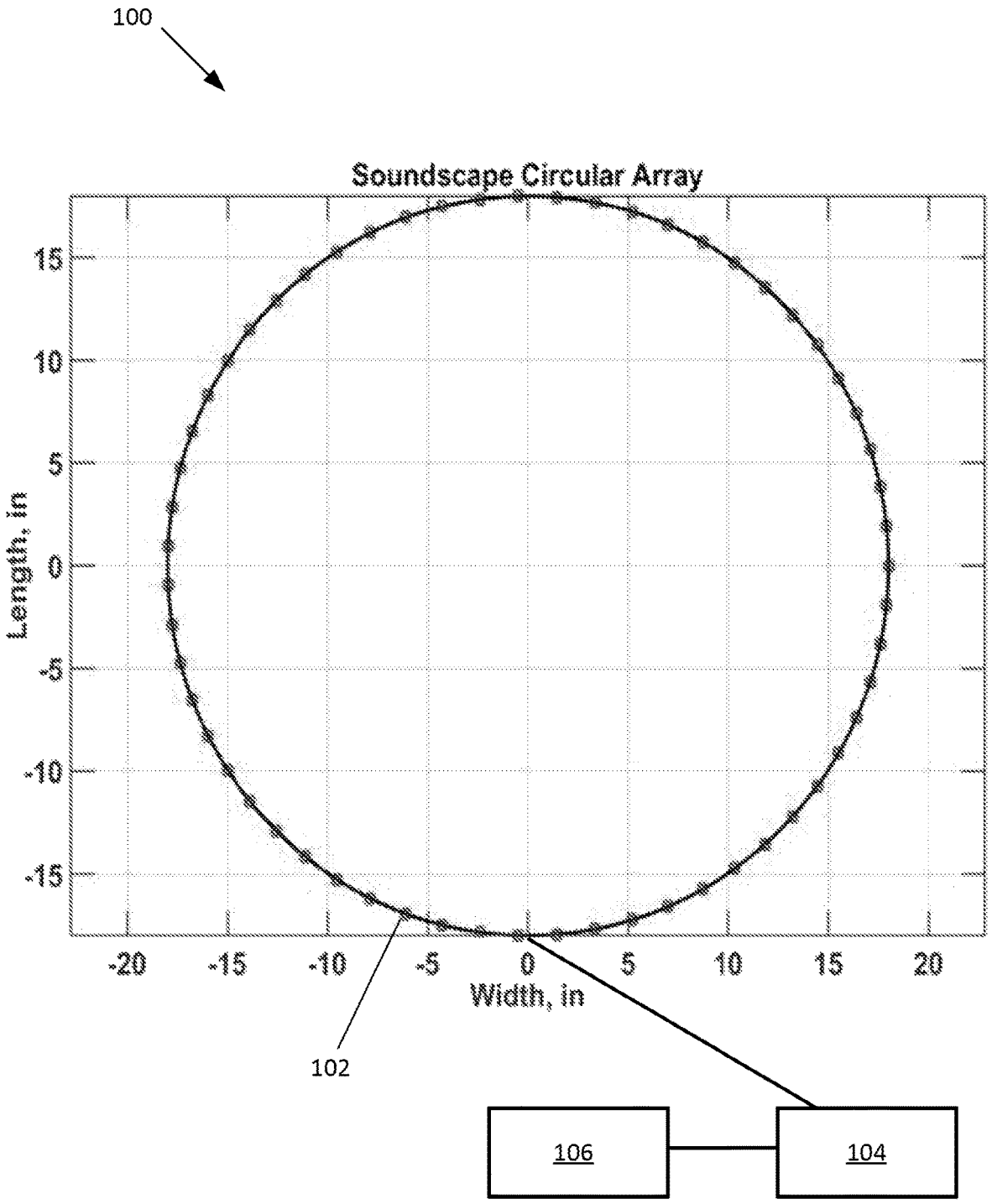
FIG. 1 depicts an example of a layout of a Soundscape Circular Array system (viewed from above), according to an exemplary embodiment of the present disclosure.

As an example, system 100 includes an array 102 of microphones to accomplish and acquire the soundscape inputs. In exemplary embodiments, array 102 is a circular array of (N) microphones that can be easily mounted on a street view vehicle (e.g. car), for example, 36" in diameter, as shown in FIG. 1. System 100 can also include a processor 104 operative to receive sound data from the array 102. Processor 104 can be connected to a suitable memory unit 106, as shown. Though a circular array 102 is shown in FIG. 1, one of ordinary skill in the art will understand that an array can have any configuration and distribution of array elements (microphones or other acoustic sensors) that function over any desired acoustic frequencies, e.g. near DC up through ultrasonic. Other exemplary embodiments include a space-filling array, e.g., shaped as a hemisphere, cleaved dodecahedron, or the like.

In preferred embodiments, the elements of the array 102 are positioned in a radial arrangement, over a full 360 degrees of azimuth (2π radians). The positioning between the individual array elements is preferably selected based on the targeted or designed-for auditory frequency range of interest. For example, to accommodate and cover the telephonic audio frequency band (300 to 3,500 Hz), the microphone spacing will need to be ½ the wavelength at 3,500 Hz, or about 2 inches (5.08 cm). Using a typical size of a car-mounted platform, and assuming a diameter of 36 inches (91.44 cm), this array will therefore contain 59 microphones. Of course, other numbers (e.g., N=24, 48, 64, 99, 200, etc.) and spacings/configurations of sensor array elements can be used within the scope of the present disclosure.

Given a microphone array with a prescribed sensor spacing, the set of individual microphone measurements may be coherently combined using a weighted summation to form an array response. The algorithm used to effect this weighted summation is called a linear or conventional beamformer (CBF), which is well known in the signal processing literature (see, e.g., Array Signal Processing: Concepts and Techniques, D. Johnson and D. Dudgeon, Prentice Hall, 1993). The filter coefficients that comprise the beamformer algorithm are determined by the steering direction of the desired array response, the relative sensor spacing, the frequency of the acoustic signal, and the propagation speed of sound in the surrounding medium. A beamformer may be implemented in the time domain directly using digitized microphone measurements. However, it is often computationally advantageous to implement the beamformer in the frequency domain once the digitized microphone timeseries have been transformed to the frequency domain using a Fast Fourier Transform (FFT) algorithm. The beamforming algorithm results in a frequency-dependent beam response characterized by a high degree of directivity or spatial selectivity. In preferred embodiments, the processor 104 can provide autonomous real-time processing that effects joint detection and classification of acoustic sources from the acoustic data, as described in co-owned and copending U.S. patent application Ser. No. 15/495,536, entitled "System and Method for Autonomous Joint Detection-Classification and Tracking of Acoustic Signals of Interest," filed Apr. 24, 2017; and in U.S. Provisional Patent Application No. 62/327,337, entitled "Title: Autonomous, Embedded, Real-Time Digital Signal Processing Method and Apparatus for Passive Acoustic Detection, Classification, Localization, and Tracking from Unmanned Undersea Vehicles (UUV) and Unmanned Surface Vehicles (USV)," filed Apr. 25, 2016; the entire content of both of which applications is incorporated herein by reference.

Figure 2:
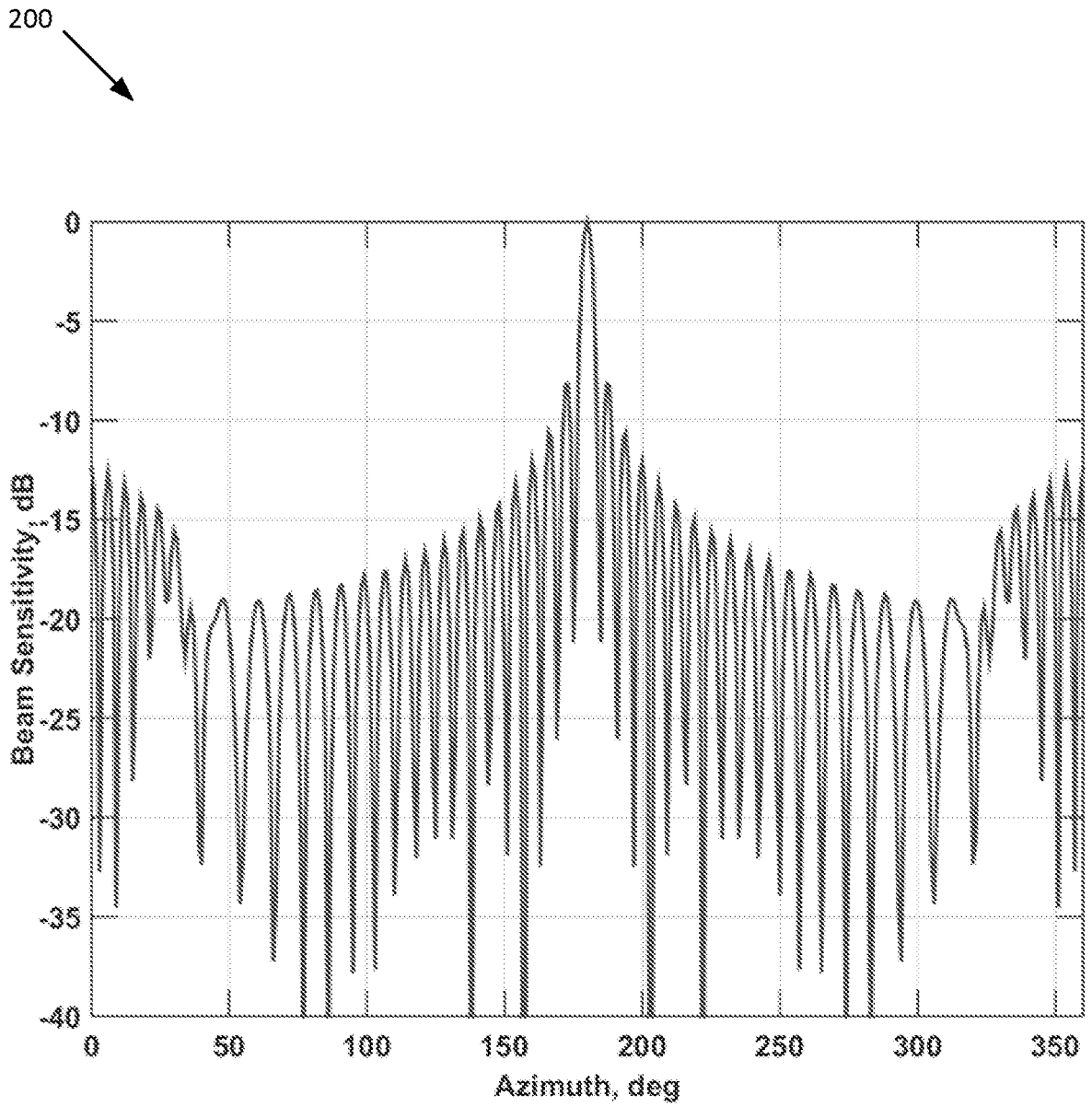
FIG. 2 depicts an azimuthal directivity for Soundscape Circular Array steered to 180 degrees, according to an exemplary embodiment of the present disclosure.

In the horizontal plane (i.e., 0 degree elevation angle), an example 200 of the directivity of the array is given in FIG. 2, for array 102 steered to an azimuth angle of 180 degrees. Since this array is axis-symmetric, the directivity is the same as in FIG. 2 when the array is steered to any azimuth angle in the horizontal. The maximum, or peak sensitivity, in array response is known as the mainlobe response and it is centered on the main response axis (MRA). Lower amplitude peaks in the array response occurring at azimuthal angles away from the MRA, are known as sidelobes, and characterize the sidelobe response of the array. This figure shows that, in the horizontal, the array is selective in azimuth angle in that sounds arriving at the array from sources at azimuth angles other than 180 degrees via the sidelobe response are attenuated by 10 dB or more.

Shading functions, such as Taylor or Hanning tapers, are commonly used to tune the array response to yield improved attenuation of unwanted sound sources arriving from array sidelobe directions. Such functions are widely known in the digital signal processing literature (see, e.g., Array Signal Processing: Concepts and Techniques, D. Johnson and D. Dudgeon, Prentice Hall, 1993). By employing a simple shading algorithm this attenuation can be increased well beyond 10 dB with the sacrifice of a slightly wider peak at 180 degrees. Once the array response has been appropriately tuned to minimize sidelobe contamination, the frequency-dependent array response along each MRA may be further processed through a digital processing algorithm known as an inverse Fast Fourier Transform (IFFT). The IFFT transforms the frequency-dependent array response back to the time domain, yielding a time series of the array response arriving along each steered azimuthal direction, with minimal contamination from sound sources emanating from unwanted sidelobe directions. The result is a reconstruction of the sound arriving at the array from about 59 different azimuthal directions, painting a soundscape of the acoustical environment that is spatially specific to a given pointing or steering direction and evolves over time. A similar process occurs in the hearing of certain mammals (e.g., dogs and horses) as their ears rotate to isolate sounds arriving from certain directions (not having to turn their heads as humans do). In this way, the array can reduce the sounds coming from loud unwanted noise sources to reveal quieter sounds arriving from different azimuthal angles. This capacity of multiple sensors providing enhanced sensitivity in a preferred listening direction by rejection of unwanted noise or sound sources in sidelobe directions is known as array gain.

Figure 3:
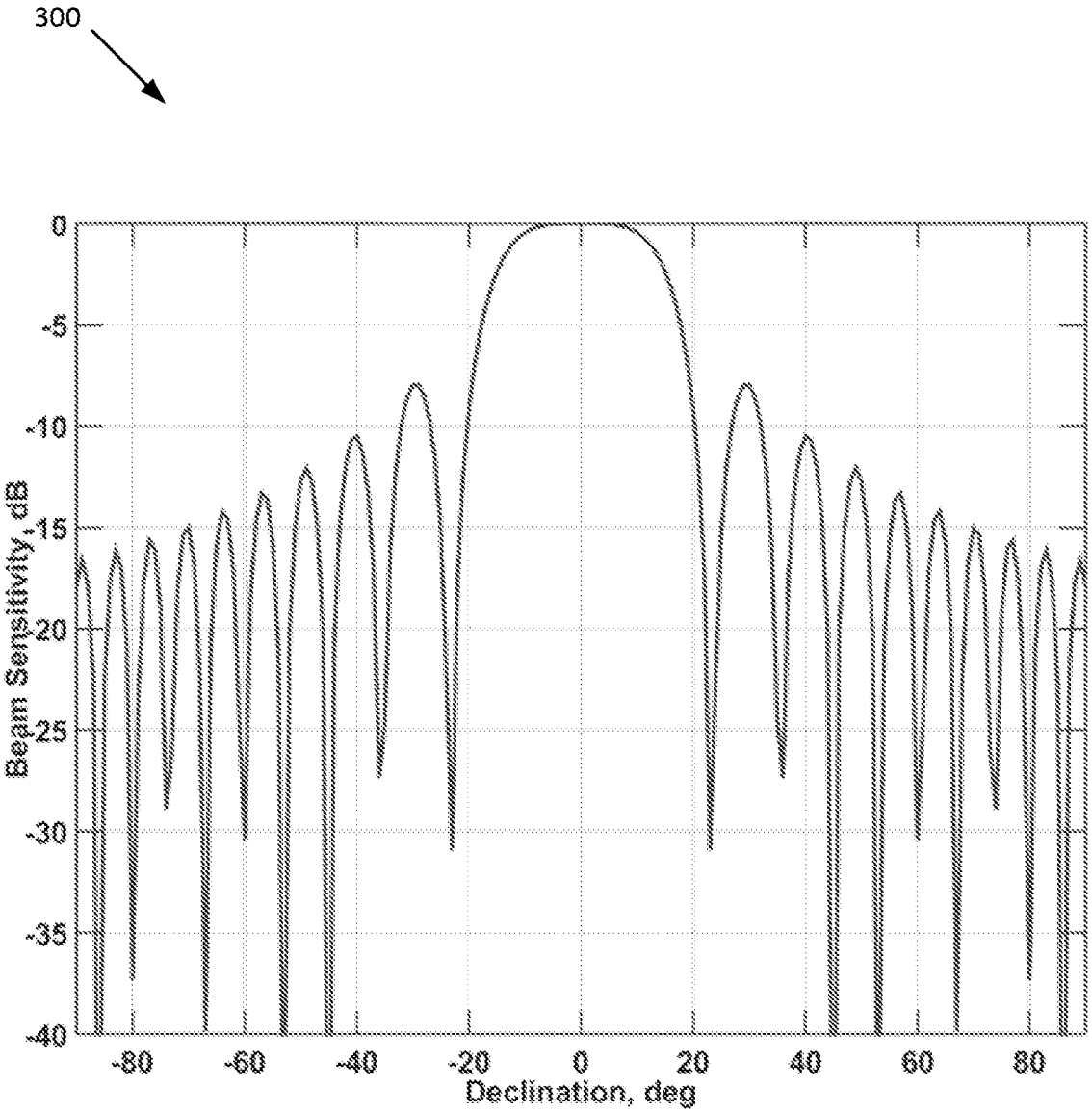
FIG. 3 depicts a vertical directivity for Soundscape Circular Array steered to horizontal (declination=0), according to an exemplary embodiment of the present disclosure.

An array such as 102 is also selective in the vertical direction as is shown in FIG. 3. This figure shows an example 300 of the array's sensitivity to sound arriving from sources above and below the horizontal plane (the array is steered along the horizontal, at an elevation angle of zero). This figure shows that sounds arriving from sources at more than about 40 degrees from the horizontal are attenuated by 10 dB or more. This is important because typically a major source of unwanted noise is the vehicle that carries the camera (used to record the pictures for the mapping application e.g., Streetview), which vehicle is typically located below the horizontal of the platform on which the camera is mounted.

Accordingly, it is preferable to mount the sound-recording array 102 high enough above the vehicle (e.g., car) so that most or all of the noise sources on the car will fall below, e.g., 40 degrees from the horizontal. In some situations, it is likely that the soundscape recordings will be made while the recording car is in motion or in a windy environment. It will therefore be important to place adequate wind screens to the microphones to minimize the noise generated by airflow across the sensing elements. Initial testing of the system can be used to determine the relative contributions of the car and wind noise sources. If these are determined to be a problem, more advanced processing techniques, such as adaptive beamforming, can be used to increase the suppression of very strong noise sources that may not be suppressed through the use of simple shading functions. Adaptive beamforming is a widely known technique in the signal processing literature (see, e.g., Statistical and Adaptive Signal Processing, D. Manolakis, V. Ingle, and S. Kogon, McGraw-Hill, 2000). The approach employs measurements of the background noise distribution to yield an optimum shading function that more aggressively filters contributions from unwanted sound sources. The approach derives its performance benefit from the fact that instantaneous measurement of the background noise distribution is used to inform the computation of array response filter coefficients. The method is more demanding to implement computationally than the normal shading function mentioned above. However, the additional computational requirement is easily accommodated with real-time embedded computing platforms that are commercially available today.

Figure 4:
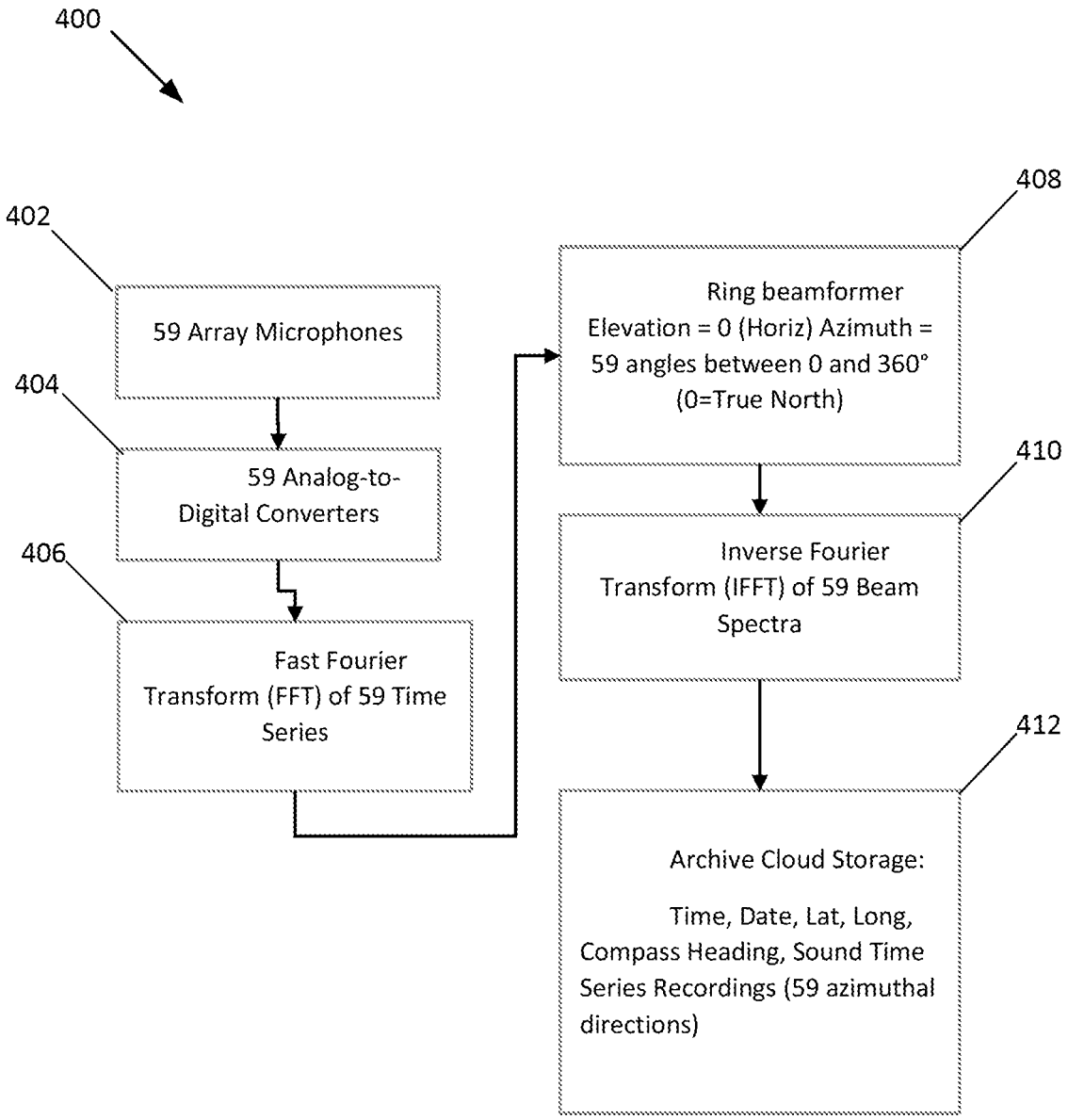
FIG. 4 depicts an example of a real-time processing block diagram (mobile system on Street View Car), according to an exemplary embodiment of the present disclosure.

A block diagram of an example 400 of a processing algorithm used for soundscape recording is shown in FIG. 4. Here it is shown that the 59 microphone signals from array 102 are received at step 402 and converted at step 404 to digital signals and transformed at step 406 into the frequency domain (e.g., by a FFT or other suitable transform) for the beamforming process. These frequency spectra are then beamformed, at step 408, into 59 beams, all in the horizontal plane but equally distributed in azimuth. Initially these beams are given at angles relative to the heading of the street view car but using the car's heading are transformed to angles relative to true north. The final step in the process (prior to archiving the data) is to transform, at step 410, the beams back to the time domain (as beam time series) using an inverse Fourier transform algorithm, e.g., the inverse discrete Fourier transform (IDFT), so they can be played over a user's speaker system. As shown at step 412, the data can optionally be stored, e.g., on the Cloud or a suitable database. The data archive preferably includes the position of the recording system (latitude and longitude), the time of day, the date and array heading, along with the 59 beam time series (e.g., each approximately 1 min in length). In exemplary embodiments, the system's processor is further operative to provide shading of the array elements. The processor can also be operative to provide adaptive beamforming. Moreover, the processor can be operative to provide autonomous real-time processing. For example, the processor can provide autonomous real-time processing that effects or produces joint detection and classification of acoustic sources from the acoustic data as described in co-owned and copending U.S. patent application Ser. No. 15/495,536, entitled "System and Method for Autonomous Joint Detection-Classification and Tracking of Acoustic Signals of Interest," filed Apr. 24, 2017; and in U.S. Provisional Patent Application No. 62/327,337, entitled "Title: Autonomous, Embedded, Real-Time Digital Signal Processing Method and Apparatus for Passive Acoustic Detection, Classification, Localization, and Tracking from Unmanned Undersea Vehicles (UUV) and Unmanned Surface Vehicles (USV)," filed Apr. 25, 2016; the entire content of both of which applications is incorporated herein by reference.

The processor may also be operative to allow an operator to perform quality control on the N beam time series at any given time and to re-record data as desired.

Figure 5:
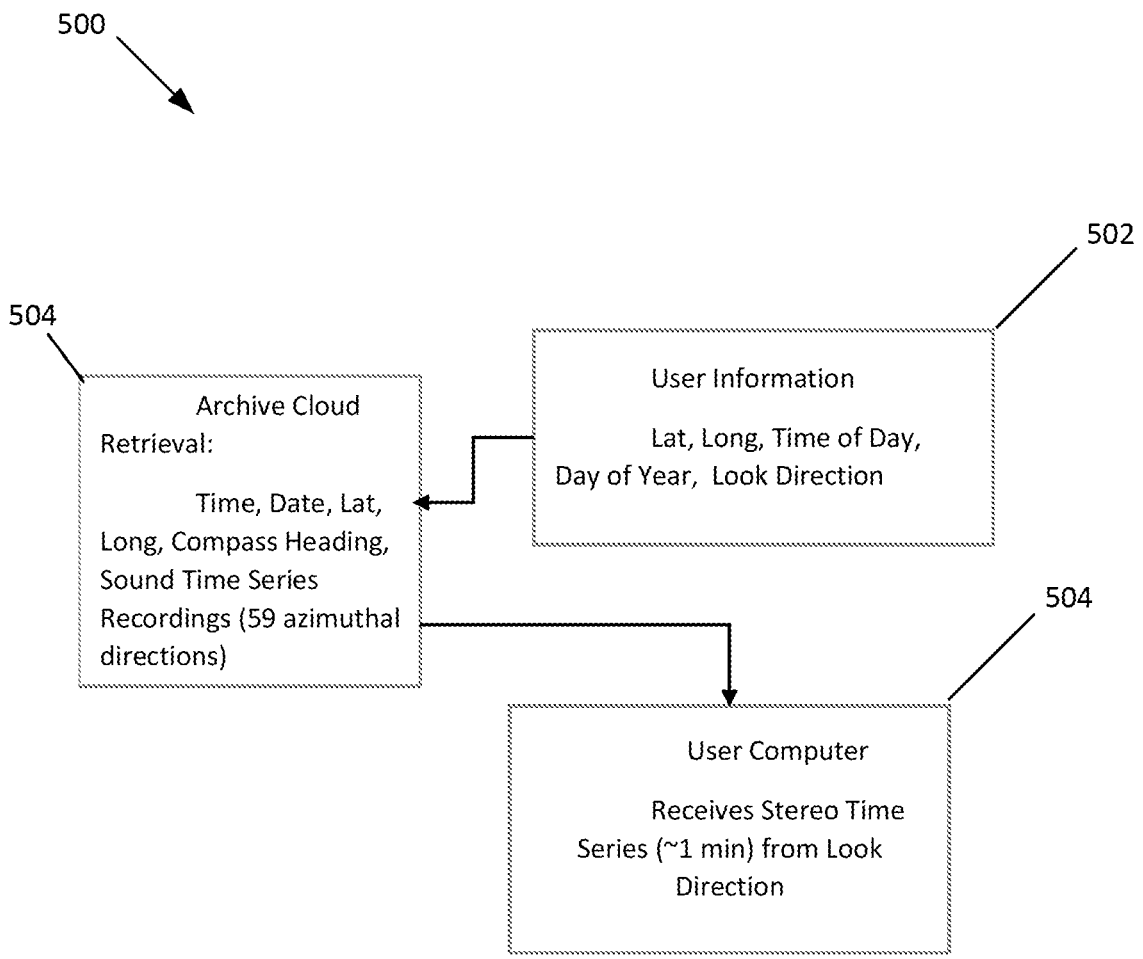
FIG. 5 depicts an example of a data recall processing block diagram (internet map user), according to an exemplary embodiment of the present disclosure.

FIG. 5 is a block diagram of an example 500 of an online application map user's playback process. The map application will need to supply the location (latitude and longitude) of the user's position on the map, along with the user's look direction and the time of day and year that the user is interested in, as shown at step 502. Given this information, the soundscape archive can be accessed, as shown at step 504, to select a stereophonic playback file (two beam time series) from the user's look direction to send to the user's computer sound system, as shown at step 504.

The components, steps, features, objects, benefits, and advantages that have been discussed are merely illustrative. None of them, or the discussions relating to them, are intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

For example, the array of microphones may be mounted to an aerial drone (UAV) or a hiker (along with a camera) to access the soundscape in remote places that are inaccessible to vehicular traffic. Also, the array may be composed of underwater microphones (hydrophones) and mounted to an underwater drone (UUV) or swimmer and used to access the vast undersea soundscape, which includes a rich audio environment of marine life and anthropogenic sounds. In any case, since the processing is done autonomously and in real-time, the array operator could be equipped with headphones for an initial on-site quality-control play-back. Alternative array and processor designs, with various sensor types can be used in widely diverse fields such a seismic/volcanic activity detection (using seismic sensors). While the emphasis in this patent description is on the integration of a soundscape into on-line mapping applications such as StreetView, the soundscape methodology described herein could be integrated into any continuous video processing, recording, and transmission system in which the response of a microphone array is synchronized with the pointing direction of the camera in such a way as to simultaneously increase the sensitivity of the microphone array to the video subject. The result would be that the visual scene captured by the camera is temporally and spatially linked with the acoustic scene, uncontaminated by background noise or loud sound sources that would otherwise compromise the viewers ability to hear what is in the field of view of the camera or video recording device. The present disclosure also provides the capability to update and/or monitor soundscapes over time at any physical location. For example, time-series "snapshots" of a particular spot in New York City could be monitored at regular periods, e.g., yearly, and the results uploaded to a database, e.g., in the Cloud, for monitoring, post-processing, and/or other statistical analysis at a later date.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. A system for providing soundscapes for online mapping applications, the system comprising:

an acoustic transducer array having a plurality of N elements operative to detect and acquire sound for azimuth and vertical bearings at a given location, and to provide sound signals indicative of the sound received from azimuth bearings at the given location;

a computer-readable non-transitory storage medium, including computer-readable instructions; and a processor connected to the memory and operative to produce N auditory beam time series audio signals, one for each of a plurality of N azimuthal directions, wherein the processor, in response to reading the computer-readable instructions, is operative to:

(i) transform the time-domain sound signals into frequency-domain spectra;

(ii) beamform the spectra into N beams; and (iii) transform the N beams into the time domain as N beam time series, in order to produce the N auditory beam time series audio signals, one for each of the N azimuthal directions;

wherein the processor is operative to provide the N auditory beam time series audio signals as a soundscape in an online mapping application.

2. The system of claim 1, wherein the beams are equally distributed in azimuth.

3. The system of claim 2, wherein the processor is further operative to, based on a recoding vehicle's heading, transform the beam angles relative to true north.

4. The system of claim 1, wherein N=59.

5. The system of claim 1, wherein the processor is further operative to provide the N beam time series to a database for storage.

6. The system of claim 5, wherein the database is in a cloud computing environment.

7. The system of claim 1, wherein the processor is further operative to provide shading the array.

8. The system of claim 1, wherein the processor is further operative to provide adaptive beamforming.

9. The system of claim 1, wherein the processor is further operative to provide autonomous real-time processing.

10. The system of claim 9, wherein the processor is operative to allow an operator to perform quality control on the N beam time series at any given time and to re-record data as desired.

11. The system of claim 1, wherein the processor is further operative to (iv) detect and jointly classify targets of interest from acoustic data.

* * * * *